US012297010B2

(12) United States Patent
Dangl

(10) Patent No.: US 12,297,010 B2
(45) Date of Patent: May 13, 2025

(54) CONTAINER CLOSURE

(71) Applicant: ALPLA WERKE ALWIN LEHNER GMBH & CO. KG, Hard (AT)

(72) Inventor: Matthias Dangl, Waidhofen an der Thaya (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 157 days.

(21) Appl. No.: 17/778,702

(22) PCT Filed: Nov. 17, 2020

(86) PCT No.: PCT/EP2020/082391
§ 371 (c)(1),
(2) Date: May 20, 2022

(87) PCT Pub. No.: WO2021/009310
PCT Pub. Date: May 27, 2021

(65) Prior Publication Data

US 2023/0041392 A1 Feb. 9, 2023

(30) Foreign Application Priority Data

Nov. 20, 2019 (CH) ..... 01467/19
Dec. 23, 2019 (CH) ..... 01695/19
May 18, 2020 (CH) ..... 00601/20

(51) Int. Cl.
*B65D 41/34* (2006.01)
*B65D 1/02* (2006.01)

(52) U.S. Cl.
CPC ..... *B65D 41/3447* (2013.01); *B65D 1/0246* (2013.01); *B65D 2401/30* (2020.05)

(58) Field of Classification Search
CPC ..... B65D 41/0421; B65D 41/0428; B65D 41/3423; B65D 2251/023; B65D 41/00; B65D 41/3428
(Continued)

(56) References Cited

U.S. PATENT DOCUMENTS 3,568,871 A * 3/1971 Livingstone ..... B65D 41/185 215/354
3,750,821 A * 8/1973 Sourbet ..... B65D 41/3428 215/365
(Continued)

FOREIGN PATENT DOCUMENTS

DE 3515719 A1 11/1986
DE 4212627 A1 10/1993
(Continued)

OTHER PUBLICATIONS

PCT International Search Report, International application No. PCT/EP2020/082391, mailed May 20, 2021, 4 pages.
(Continued)

*Primary Examiner* — Ernesto A Grano
(74) *Attorney, Agent, or Firm* — MORRISS O'BRYANT COMPAGNI CANNON, PLLC

(57) ABSTRACT

A plastic container closure has a screw cap with a cylindrical casing having an internal screw thread and a lid disc adjoining the casing, a security ring connected by first break-off webs to a free edge of the casing and a holding ring in the region of the container neck. The security ring has slots distributed over its circumference and each have a top edge and a bottom edge, wherein the top edge is formed by a section of the security ring that extends in the shape of a circular arc. The bottom edge is formed by a wall section
(Continued)

Figure 1:
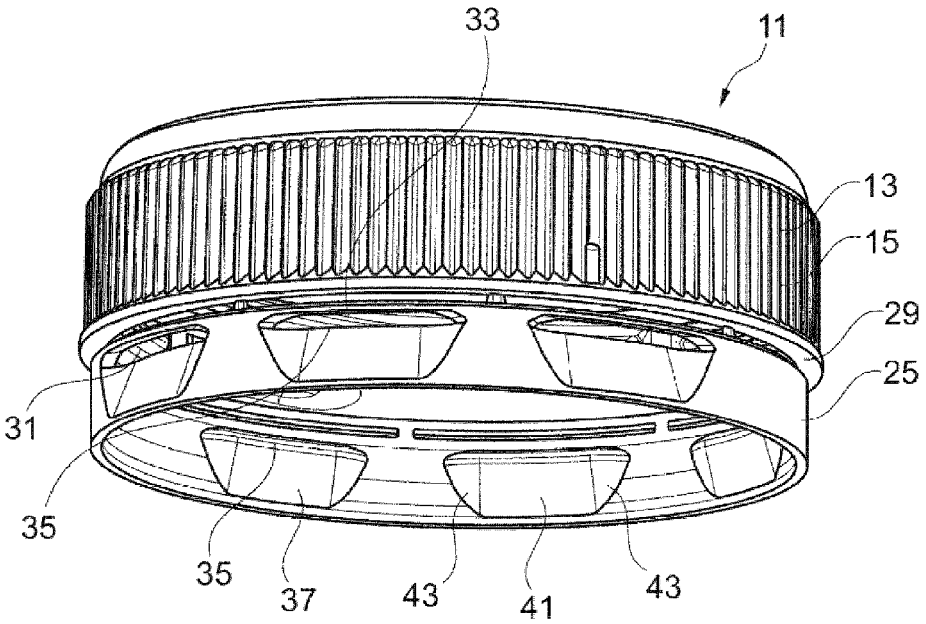

that is inclined inwards in a radial direction. The bottom edge of each slot engages in a form-fitting manner with the holding ring.

21 Claims, 9 Drawing Sheets

(58) Field of Classification Search
USPC ..... 215/252
See application file for complete search history.

(56) References Cited

U.S. PATENT DOCUMENTS 4,196,818 A * 4/1980 Brownbill ..... B65D 41/3428 215/DIG. 1
4,572,388 A * 2/1986 Luker ..... B65D 41/3428 215/252
RE32,879 E * 2/1989 Wright ..... B65D 41/3428 215/252
4,863,050 A * 9/1989 Perry ..... B65D 41/3428 215/252
5,267,661 A * 12/1993 Luch ..... B65D 41/0421 215/354
5,630,520 A * 5/1997 Luch ..... B65D 41/3409 215/256
5,673,809 A * 10/1997 Ohmi ..... B65D 41/045 215/343
5,819,965 A * 10/1998 King ..... B65D 41/3409 215/252
5,975,321 A * 11/1999 Luch ..... B65D 41/0471 215/354
6,119,883 A * 9/2000 Hock ..... B65D 41/3428 53/485
6,382,445 B1 * 5/2002 McCandless ..... B65D 41/0428 215/DIG. 1
8,459,486 B2 * 6/2013 Luburic ..... B65D 41/32 220/780
9,815,603 B2 * 11/2017 Bannini ..... B65D 50/00
10,913,580 B2 * 2/2021 Browne ..... B65D 41/40
2001/0015341 A1 * 8/2001 Higgins ..... B29C 45/33 425/441
2001/0027957 A1 * 10/2001 Kano ..... B65D 41/3428 215/354
2002/0158037 A1 * 10/2002 Kano ..... B65D 41/0421 215/354
2002/0166859 A1 * 11/2002 McGrew, Jr. ..... B65D 51/1622 220/366.1
2005/0006334 A1 * 1/2005 Luker ..... B65D 41/0485 215/334
2005/0189312 A1 * 9/2005 Bixler ..... B65D 41/3428 264/295
2005/0252878 A1 * 11/2005 Babcock ..... B65D 41/3428 215/252
2005/0269282 A1 * 12/2005 Luch ..... B65D 41/0471 215/354
2007/0251911 A1 * 11/2007 Russell ..... B65D 41/0414 215/344
2008/0087625 A1 * 4/2008 Kumata ..... B65D 41/0485 215/252
2009/0152229 A1 * 6/2009 Falzoni ..... B65D 41/3409 215/331
2009/0321378 A1 * 12/2009 Battegazzore ..... B65D 41/3428 215/277
2010/0032402 A1 * 2/2010 Widmer ..... B65D 41/3428 215/329
2011/0174762 A1 * 7/2011 Tsai ..... B65D 41/3428 264/328.18
2011/0186534 A1 * 8/2011 Nilsson ..... B65D 41/0421 215/40
2013/0200036 A1 * 8/2013 Delage ..... B65D 41/0442 215/344
2014/0021157 A1 * 1/2014 Gren ..... B65D 41/0421 215/252
2014/0158660 A1 * 6/2014 Wood ..... B65D 41/0485 215/252
2014/0263335 A1 * 9/2014 Taber ..... B65D 41/0421 220/276
2015/0298870 A1 * 10/2015 Graux ..... B65D 41/3428 215/252
2018/0127159 A1 * 5/2018 Cunningham ..... B65D 51/2807

FOREIGN PATENT DOCUMENTS

EP 1921019 A1 5/2008
EP 2088090 A1 8/2009
WO 9816436 A1 4/1998
WO 2005077777 A1 8/2005
WO 2009115443 A1 9/2009

OTHER PUBLICATIONS

PCT Written Opinion of the International Searching Authority, International application No. PCT/EP2020/082391, mailed May 20, 2021, 9 pages.

* cited by examiner

CONTAINER CLOSURE

CROSS-REFERENCE TO RELATED APPLICATIONS

This application is a national phase entry under 37 U.S.C § 371 of PCT/EP2020/082391 filed Nov. 17, 2020, which claims priority to Swiss Patent Application No. 01467/19 filed Nov. 20, 2019, and Swiss Patent Application No. 01695/19 filed Dec. 23, 2019, and Swiss Patent Application No. 00601/20 filed May 18, 2020, the entirety of each of which is incorporated by this reference.

FIELD OF THE INVENTION

The invention relates to a container closure made of plastic and a container, in particular a plastic bottle having a container closure.

PRIOR ART

Most caps from the prior art in the field of plastic caps are fitted with a security ring. The security ring is connected to a screw cap with break-off webs that are arranged along its circumference. The screw cap comprises a cylindrical casing and a lid disc adjoining thereto. The casing has an internal thread, whereby the screw cap can be screwed onto a container neck with an external thread. The break-off webs connect the open edge of the cylindrical casing to the security ring. If the break-off webs are severed, this indicates that the screw cap has already been unscrewed from the container at least once.

In order for the break-off webs to break when the screw cap is unscrewed, the security ring must be held on the container neck in the axial direction so that the axial distance between the security ring and the screw cap can increase during unscrewing. For this reason, holding means are formed on the inside of the security ring, said holding means engaging under a holding ring formed on the container neck and extending outwards in the radial direction.

WO 2005/077777 A1 shows an embodiment that is frequently used. In this case, the security strip is designed such that it can be folded over and the folded part forms the engagement means that engages under the holding ring of the container neck. The disadvantage is, on the one hand, that the folding over represents an additional work step and, on the other hand, that material requirements for the quasi double-executed security strip are high.

Instead of the folded security strip, a variant, which is also known and frequently used, is that holding cams, which act as holding means, are provided on the inside of the security strip. Such holding cams are shown in WO 2009/115443. The holding cams must be designed such that the closure can be demolded from a tool. This leads to the cams being beveled or rounded in the engagement region. However, this shaping of the bevel disadvantageously results in it counteracting a form-fitting engagement. The retaining cams can therefore slide over the holding ring during axial loading, which opposes the reliable breaking of the break-off webs.

US 2001/0015341 A1 discloses a plurality of holding means that are designed as flaps. The bottom edge of the flaps is held on the security ring so as to be pivotable in the circumferential direction with a film hinge. The top edge is open and therefore forms a holding edge. The holding edge engages under the holding ring of the container neck. The disadvantage of this prior art is that the production is possible only with a complex molding tool having a plurality of sliders and that the tabs, under axial loads caused by unscrewing the screw cap, cannot remain reliably in the position in which they engage under the holding ring and can yield.

Advantage of the Invention

From the disadvantages of the prior art described, the advantage of the present invention is to create a plastic cap, the holding means of which grip under the holding ring even in the case of increased axial loads and thus reliably prevents the security ring from jumping over the holding ring.

Furthermore, the application force of the closure is to be reduced, i.e. the closure should be able to be pressed on to the container with less force after the container's first fill.

A further advantage is to demonstrate a closure for which the material consumption is reduced, which leads to a corresponding cost reduction.

SUMMARY OF THE INVENTION

The stated advantages for a container closure made of plastic is achieved by the features stated in the independent claims. The dependent claims set out developments and/or advantageous alternative embodiments.

The invention comprises a security ring having slots that are arranged distributed over the circumference and have a top edge and a bottom edge, wherein the top edge is formed by a section of the security ring that extends in the shape of a circular arc, and the bottom edge is formed by a wall section that is inclined inwards in the radial direction, and that the bottom edge of each slot forms the engagement means for a form-fitting engagement into an abutment arranged in the region of the container neck. Since the engagement means in the form of the inwardly-inclined wall sections are not on the entire circumference of the security ring, and slots are also present by the molding of which the amount of material used is even further reduced, the material requirement of plastic can be significantly reduced by up to 5%. In addition, the wall section is immovable inwards in the radial direction, whereby the security ring is held on the holding ring and cannot be pulled over it until the security ring is stretched along its circumference. The security ring is rigidly held on the holding ring by the wall sections such that the break-off webs safely tear before the holding of the wall sections is overcome. However, the wall sections are flexible or movable outwards in the radial direction. As a result, the wall sections can be demolded from the injection mold or the injection-molding tool with little exertion of force. For the same reason, the application force for pressing the container closure is significantly reduced in comparison to the prior art. Expansion of the security ring, which can lead to permanent damage to the container closure, is largely prevented during demolding and pressing.

In a particular embodiment of the invention, the wall section has a first subsection that corresponds to an obliquely positioned casing section and has two second subsections that connect the first subsection to the casing. The second subsections hold the first subsection fixedly and prevent the latter from being pulled inwards in the radial direction by an axial unscrewing force. If the wall section is pressed outwards in the radial direction during the pressing or demolding, the second subsections yield in a defined manner since they can be deformed or compressed.

The second subsections are expediently oriented obliquely inwards facing each other. As a result, the second subsections can be deformed in a defined manner in the circumferential direction when the wall section is pressed outwards in the radial direction. The deformation is elastic and the wall section automatically returns to its basic position in which it catches under the holding ring.

It has proven advantageous if the bottom edge corresponds to the free edges of the first subsection and of the second subsections and lies in one plane. As a result, the bottom edge has a spatial extension and not only the extension of a straight line or a line. This makes it possible for the form-fitting engagement on the holding ring to be particularly stable and cannot be released by conventional axial opening forces.

In a further embodiment of the invention, the plane in which the bottom edge lies is oriented perpendicular to the central axis of the container closure. As a result, the entire bottom edge can rest against the holding ring when the security ring is pulled upwards when the screw cap is unscrewed. This embodiment therefore results in a particularly stable form fit between the wall section and the holding ring.

It proves advantageous if the inclined wall sections have a reduced wall thickness compared to the remaining security ring, wherein the region of the bottom edge has the smallest wall thickness. This dimensioning of the wall thickness improves the desired elastic deformability of the wall section outwards in the radial direction, whereby the pressability and the demoldability of the container closure are further improved.

In a further embodiment of the invention, the wall thickness of the inclined wall sections decreases in the axial direction starting from the free end of the security ring. Preferably, the wall thickness decreases linearly. As explained in the last paragraph, the desired elastic deformation of the wall section outwards in the radial direction can thereby be improved. In particular, the region of the bottom edge, which projects furthest inwards in the radial direction, is particularly easily elastically deformable outwards due to the smallest wall thickness.

In a further embodiment of the invention, at least two diametrically opposed slots are present. As a result, the security ring can be held symmetrically on the holding ring.

A plurality of slots of equal size are expediently arranged at the same distance from one another in a circumferential section of the security ring and the same number of slots is arranged in a diametrically opposed circumferential section. By increasing the number of slots, the holding force can be increased and adapted to the force that acts on the wall section during unscrewing. The diametrical arrangement of the same number of wall sections distributes the tensile force acting on the security ring symmetrically onto the wall sections.

Because the slots are advantageously the same length and have an opening angle of 15 to 30 degrees or between 23 and 27 degrees on the circumference of the security ring, the bottom edges of the slots are of sufficient length for a reliable form fit on the holding ring. Wall sections or slots of this length can be easily produced via sliders of an injection molding tool.

The invention may also be configured in that the container closure has at least one holding strip having a first and second end and a first and a second longitudinal side, wherein the first end is undetachably connected to the free edge of the casing and the second end is undetachably connected to the security ring. As a result, the screw cap is captively held on the container or on the security ring after unscrewing from the container neck. The combination of the engagement means in the form of the slots or wall sections with at least one holding strip offers the further advantage that the security strip can only be removed by destroying the container neck and the container closure is always connected to the container when the latter is disposed of.

In another embodiment of the invention, at least one recess is provided on the security ring, in which recess the holding strip is received. Due to the provision of the recess, the holding strap does not require any additional space and therefore no additional plastic is required to form the holding strip.

In another embodiment of the invention, the at least one recess is provided in a circumferential or annular section of the security ring, which is free of slots. As a result, the wall sections can ideally be combined with at least one holding strip. Since the holding force of the wall sections is greatly improved with respect to engagement means of the prior art, the wall sections need not necessarily be formed around the security ring; instead, circumferential sections of the security ring can also be present without wall sections. Said circumferential sections provide sufficient space for forming at least one holding strip. This makes it possible to prevent the holding strip from being arranged over the wall portions, which would inevitably lead to an increased height and increased material consumption.

It has proven advantageous if second break-off webs connect the first longitudinal side of the holding strip to the free edge of the casing and third break-off webs connect the second longitudinal side of the holding strip to the security ring. The second and third break-off webs stabilize the region around the at least one holding strip. As a result, the security ring can be easily pressed onto the container neck in an unchanged manner and is not weakened in the region of the holding strip. In addition, intact second and third break-off webs together with intact first break-off webs indicate the unopened container closure closed as originally. The combination of the slots or wall sections described above with at least one holding strip on the security ring is ideal. This is due to the fact that, for the holding strip to function perfectly, it must be torn off in a defined manner. The stable fastening of the security ring to the holding ring enables precisely this defined tearing off of the second and third break-off webs.

In another embodiment of the invention, the at least one holding strip is of a length such that, in the unscrewed state of the screw cap, the free edge of the casing can be locked in one of the slots and is held in the slot by the at least one holding strip. The slots therefore interact directly with the holding strip in order to hold the screw cap on the security ring. The advantage of this type of clamping is that it is independent of the support ring located on the preform or on the container. Since the support ring can have a variable design with respect to the diameter and its position on the container neck, clamping under the support ring has the disadvantage that the length of the holding strip must always be adapted specifically to the design of the support ring. It is possible to hold the unscrewed screw cap on the container closure itself and this is independent of the container and its support ring and the dimensions thereof.

In another embodiment of the invention, two holding strips are provided, the length of which is dimensioned such that they pull the free edge into one of the slots when the screw cap is unscrewed, whereby the free edge locks in the slot. Preferably, the two holding strips are tensioned when the screw cap is held in the slot. As a result, the screw cap is held in a particularly stable and reliable manner on the security ring. After the container has been used, the screw cap can be detached from the security ring and screwed onto the container again.

Advantageously, the casing rests on the top edge of the slot and the free edge rests on the first subsection of the wall section. As a result, the screw cap is held in a stable and wiggle-free manner on the security ring.

A further aspect of the invention relates to a container, in particular a plastic bottle having a container closure according to the above description. Advantageously, the bottom edge of each slot engages under the holding ring for a form-fitting engagement. The container closure fits on all containers, in particular plastic bottles, which have a holding ring for form-fitting engagement of a security ring. Therefore, the container closure is suitable for all containers that are suitable for standard security closures having a security ring.

Further advantages and features become apparent from the following description of two exemplary embodiments of the invention with reference to the schematic representations. Shown, in a representation not true to scale, are:

BRIEF DESCRIPTIONS OF THE DRAWINGS

Figure 2:
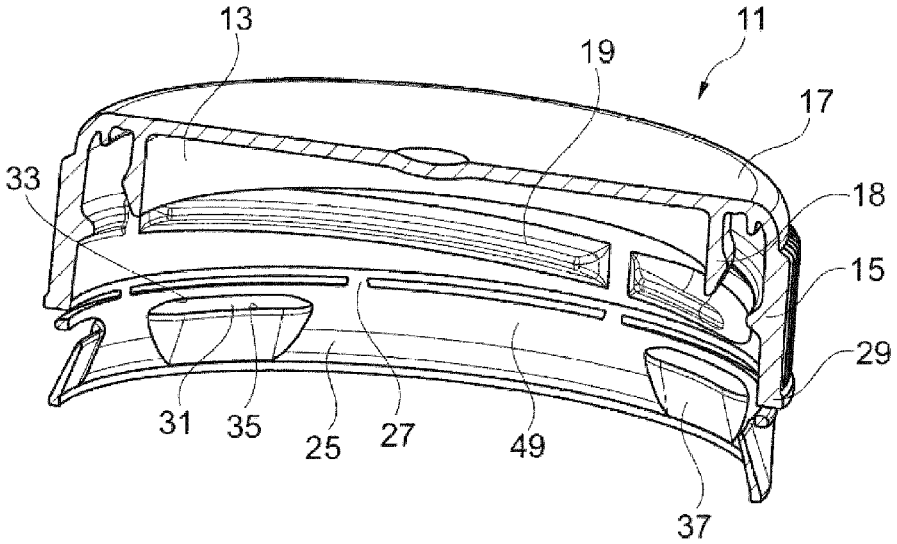
Figure 3:
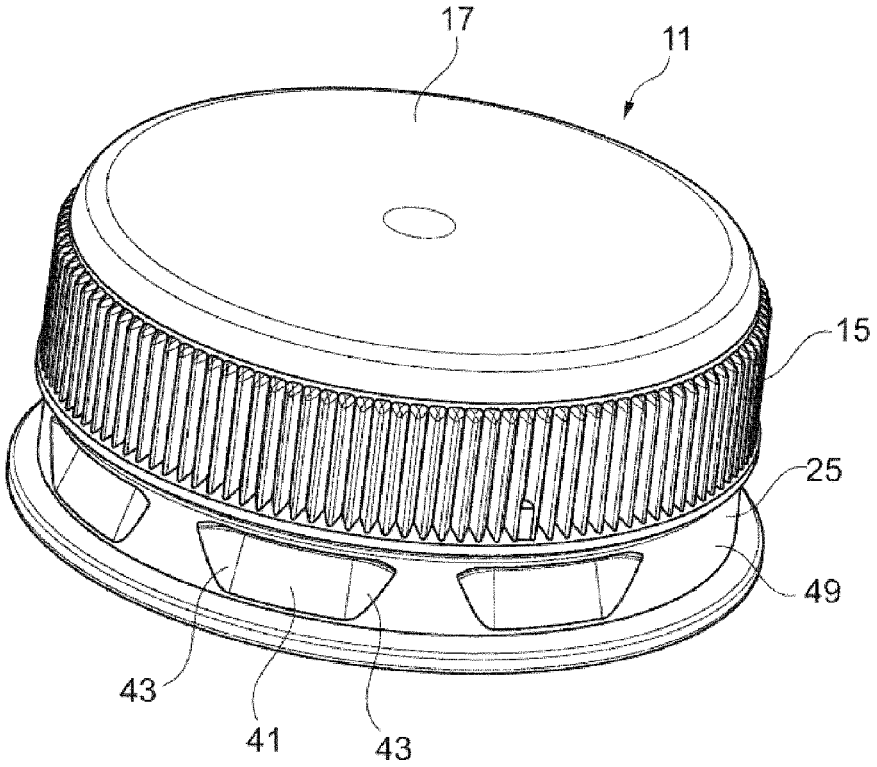
Figure 4:
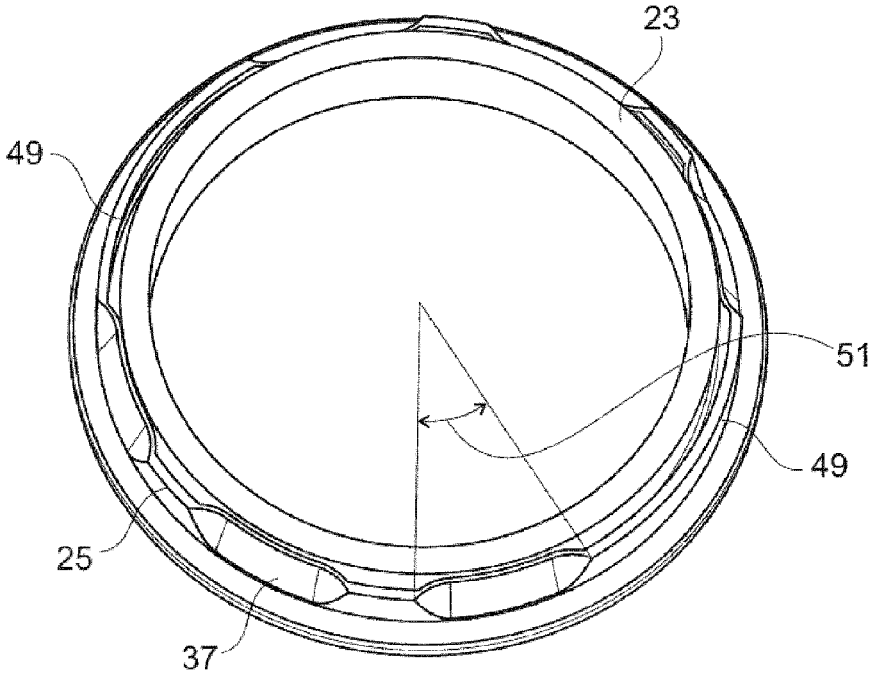
Figure 5:
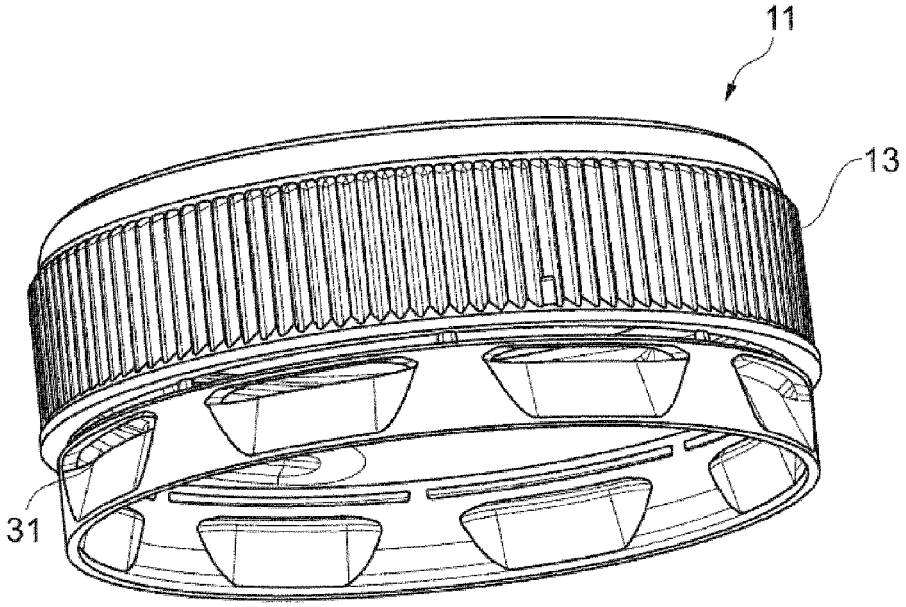
Figure 6:
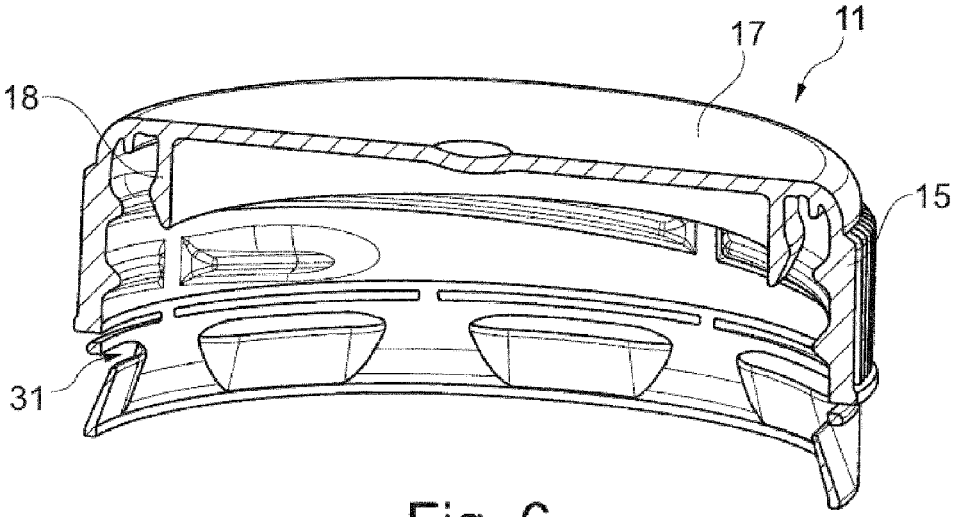
Figure 7:
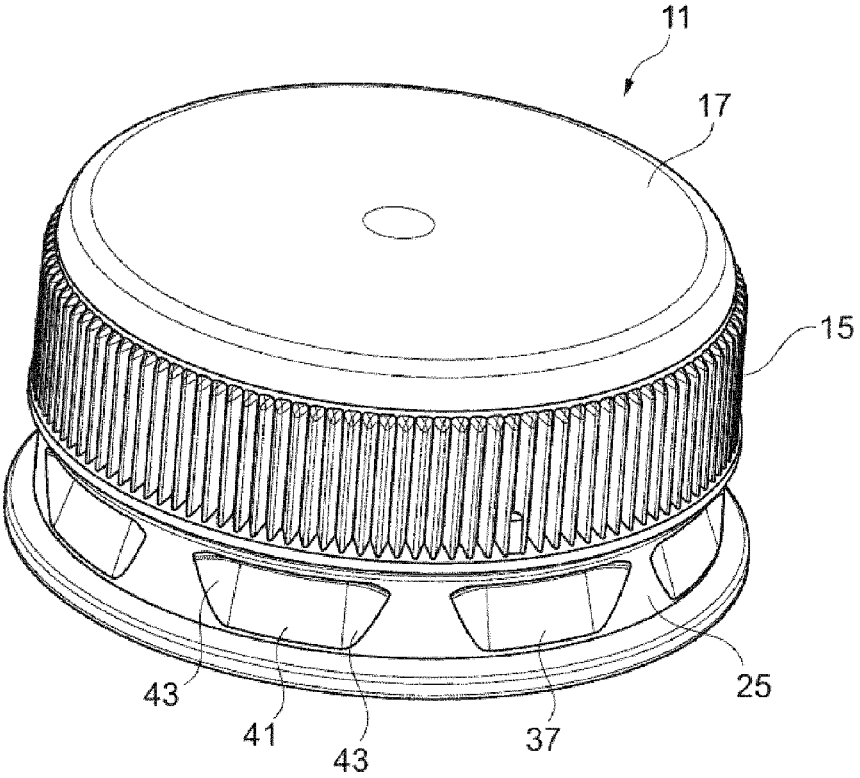
Figure 8:
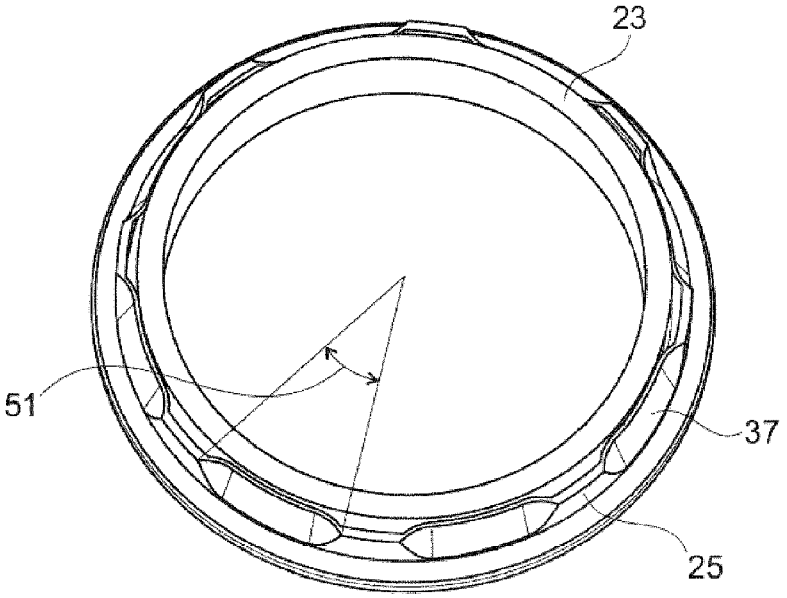
Figure 9:
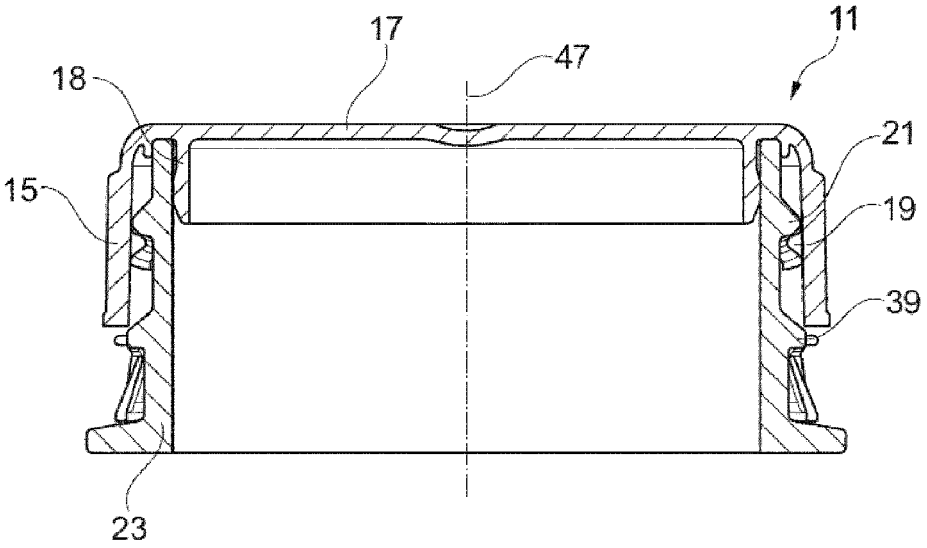
Figure 10:
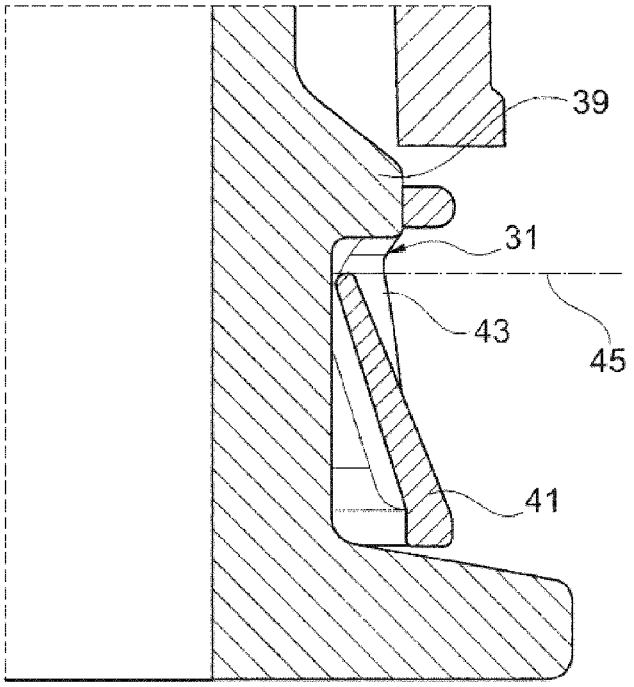
Figure 11:
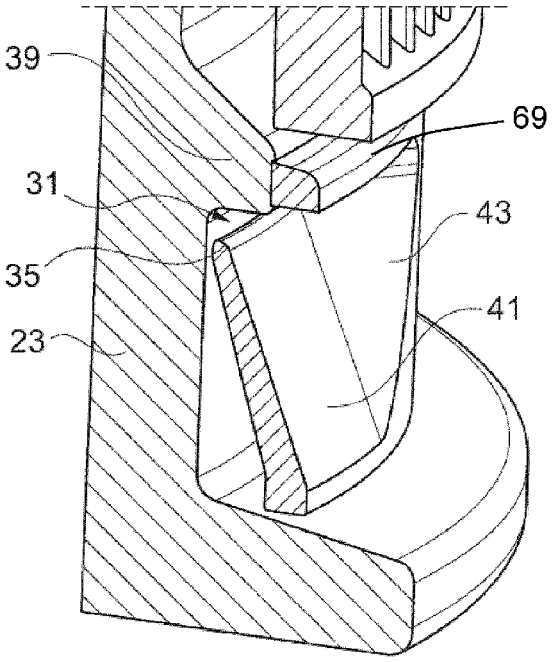
Figure 12:
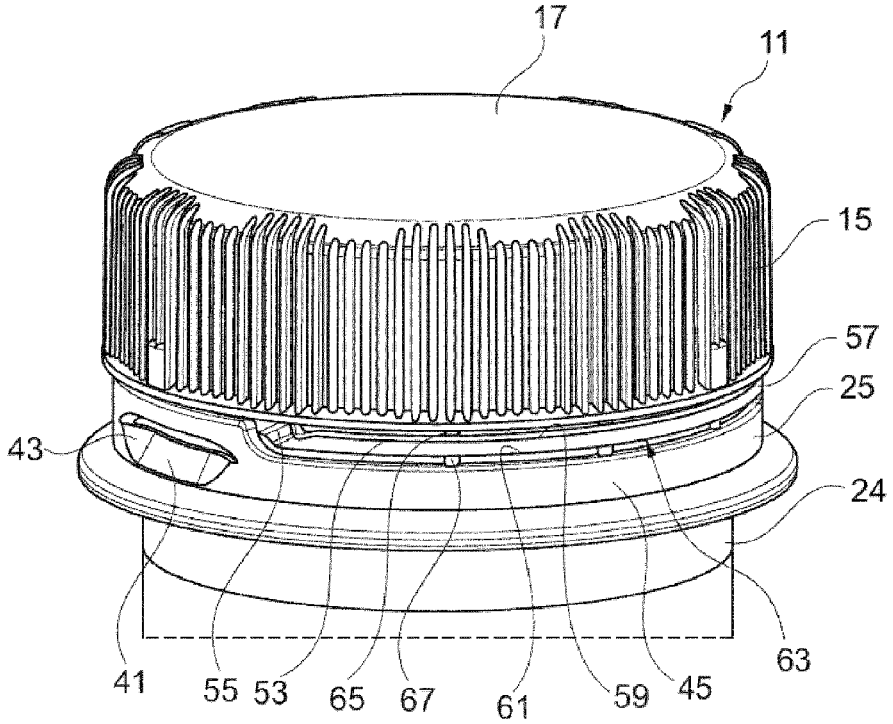

FIG. 1: a perspective view of a container closure with security ring in a first embodiment obliquely from below;

FIG. 2: a perspective longitudinal section through the first embodiment;

FIG. 3: a second perspective view of the first embodiment obliquely from above;

FIG. 4: a view of the security ring according to the first embodiment, which is placed on a container neck;

FIG. 5: a perspective view of the container closure with security ring in a second embodiment obliquely from below;

FIG. 6: a perspective longitudinal section through the second embodiment;

FIG. 7: a second perspective view of the second embodiment obliquely from above;

FIG. 8: a view of the security ring according to the second embodiment, which is placed on a container neck;

FIG. 9: a further longitudinal section through the container closure;

FIG. 10: a detailed view of an inwardly inclined wall section of the security ring;

FIG. 11: a perspective view of the wall section inclined obliquely inwardly;

FIG. 12: a perspective view of the container closure having a holding strip integrated into the security ring.

Figure 13:
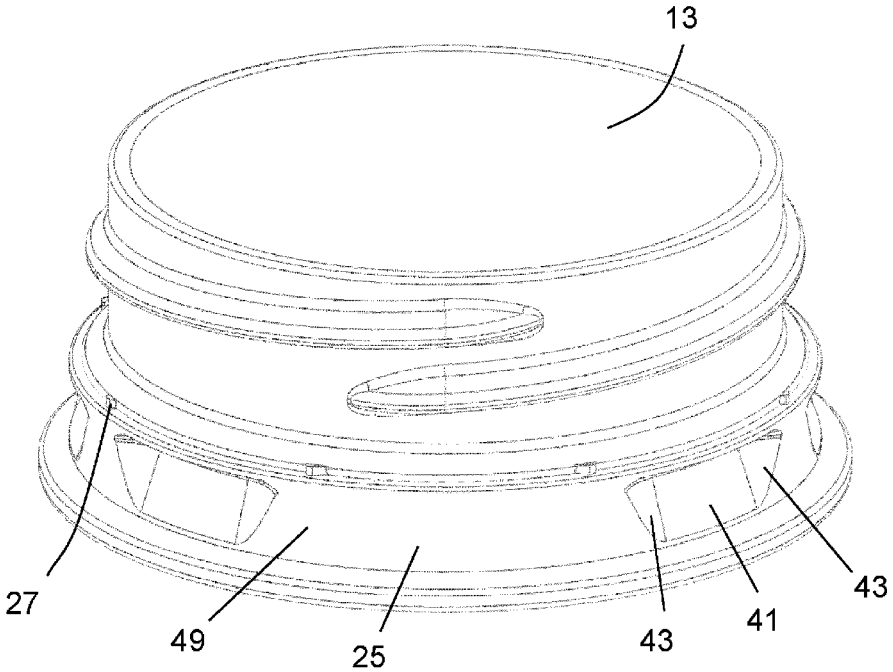
Figure 14:
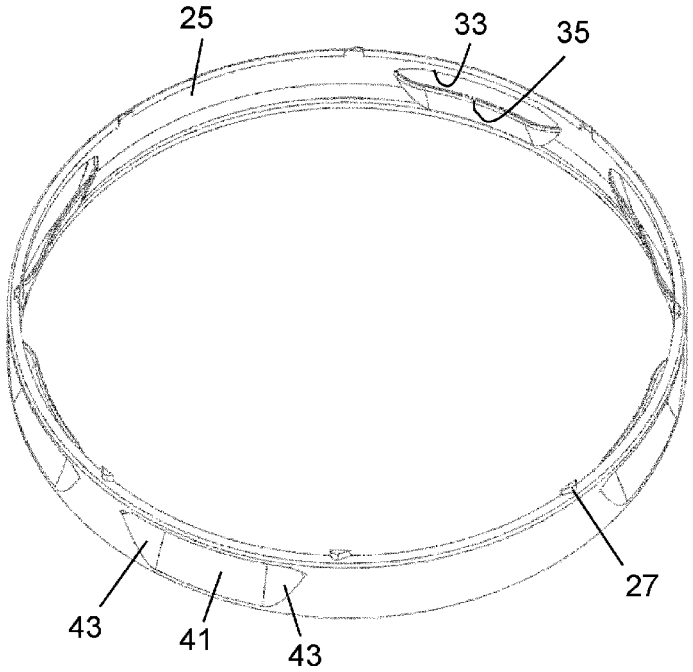
Figure 15:
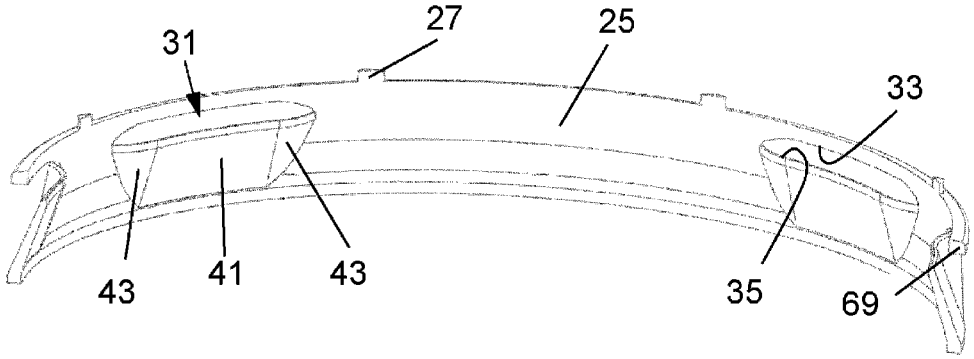
Figure 16:
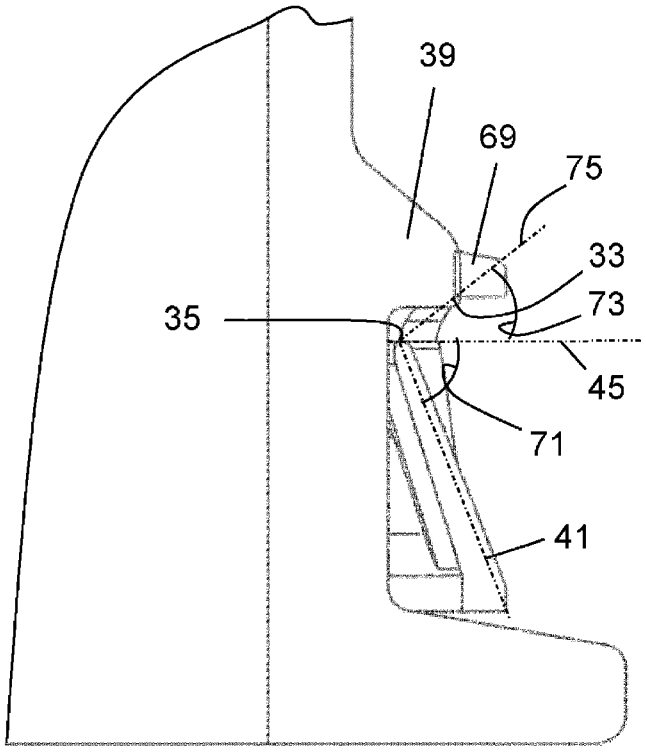
Figure 17:
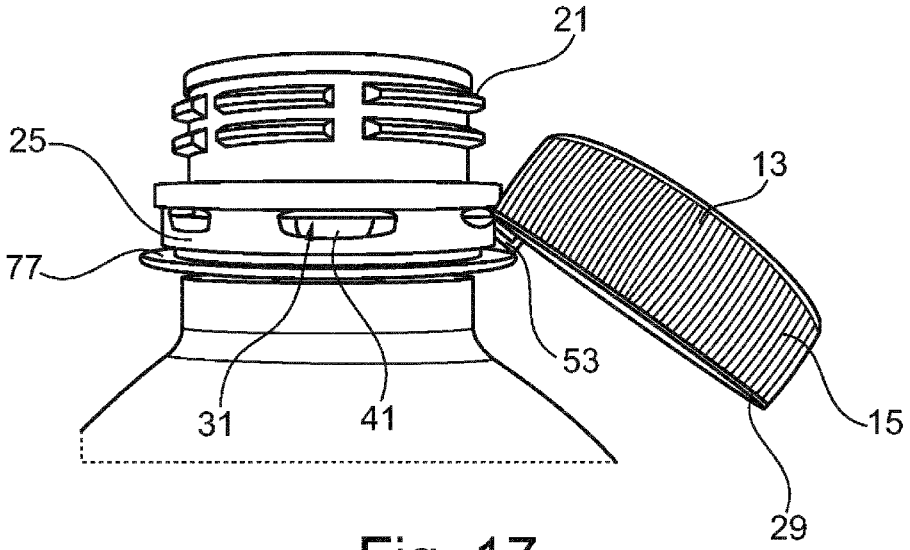
Figure 18:
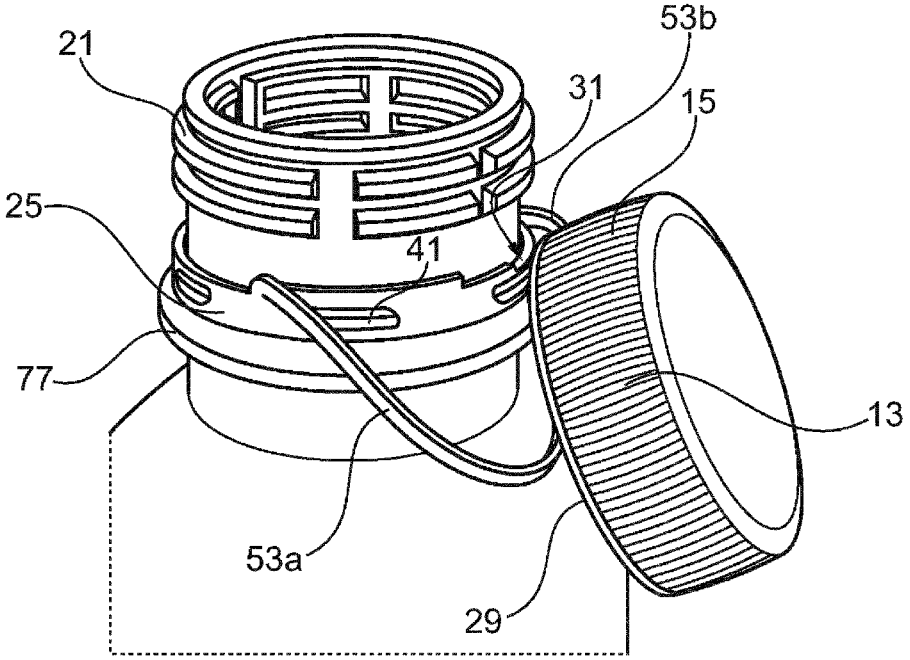

FIG. 13: a perspective view of the security ring, wherein the screw cap is unscrewed from the container neck, FIG. 14: a perspective view of the security ring FIG. 15: a longitudinal section through the security ring in a perspective view;

FIG. 16: a detailed view of an inwardly inclined wall section of the security ring with visualized inclination angles;

FIG. 17: a side view of the container closure with screw cap unscrewed, wherein the open edge of the screw cap is locked in one of the slots and is held with a holding strip, and FIG. 18: the container closure in a perspective view, wherein the screw cap is pulled into the slot by two holding strips.

DETAILED DESCRIPTION OF THE INVENTION

FIGS. 1 to 12 show a closure cap that is denoted overall by reference sign 11. A first embodiment is shown in FIGS. 1 to 4 and a second embodiment is shown in FIGS. 5 to 8. A security ring, which the container closure has, is shown separately in FIGS. 13 to 16.

The container closure 11 has a screw cap 13 that comprises a cylindrical casing 15 and a lid disc 17 adjoining the casing 15. A sealing element, for example a sealing ring 18, can be formed on the inside of the lid disc 17. The casing 15 has an internal thread 19 that interacts with an external thread 21 of a container neck 23 of a container 24 (FIG. 9). The sealing ring 18 interacts with the open edge of the container neck 23. As a result, the container 24 is tightly closed when the screw cap 13 is screwed onto the container neck 23.

The container closure 11 has a security ring 25 that is connected to the free edge 29 of the casing 15 via first break-off webs 27. When the screw cap 13 is unscrewed for the first time, the first break-off webs 27 break, as a result of which whether or not the container closure is closed as originally is immediately evident.

Slots 31 distributed over the circumference of the security ring 25 are provided on the security ring. The slots 31 each have a top edge 33 and a bottom edge 35. The top edge 33 is formed by a section of the security ring 25 in the shape of a circular arc. The bottom edge 35 corresponds to the free edge of a wall section 37 inclined inwards in the radial direction. Due to the internal inclination of the wall section 37, the bottom edge 35 has a smaller radius than the security ring 25 and can thereby abut against an abutment of the container neck 23 when the screw cap 13 is unscrewed from the container neck 23. The abutment is realized by a holding ring 39, which is formed below the external thread 21 on the container neck 23. When the threaded part 13 is unscrewed, the bottom edge 35 engages in a form-fitting manner on the holding ring 39, as a result of which the holding ring 39 is reliably held on the holding ring 39 even under high axial forces.

Each wall section 37 has a first subsection 41 and two second subsections 43. The first subsection 41 represents an inwardly-folded casing section and may be designed to be flat. The second subsections 43 adjoin the inwardly-facing sides of the first subsection 41 and connect them to the casing 15. The second subsections 43 can have a curved or flat design and face each other obliquely inwards. The bottom edge 35 of the slot 31 corresponds to the free edges of the first subsection 41 and of the second subsections 43 and lies in a plane 45, which is shown in FIGS. 10 and 16. The plane 45 may be oriented to be perpendicular to the central axis 47 of the container closure 11. These described design features of the wall section 37 have the advantage that the wall section 47, with the entire bottom edge 35 can rest against the holding ring 39 and not yield upwards in the event of an axial tensile force. As a result, the security ring 25 is held undetachably against the holding ring 39 or can be removed from the holding ring 39 only by being destroyed. A movement of the first subsection 41 inwards in the radial direction is prevented by provision of the second subsections 43. However, a movement of the first subsection 41 outwards in the radial direction is possible. This movement is flexible, and, after being pressed outwards in the radial direction, the wall section 37 returns to its inwardly inclined home position. This has the further advantage that the container closure can be easily demolded and can be pressed onto the container neck 23 with little force. As a result of the flexibility of the wall section 37, the demolding from an injection mold and the pressing onto a container neck 23 can take place without the risk of damaging the wall section 37.

The inclined wall sections 37 has a lesser wall thickness than the remaining security ring 25. FIG. 10 shows in particular that the region of the bottom edge 35 has the smallest wall thickness. The above-described flexibility of the wall section 37 outwards in the radial direction is thereby further improved. The wall thickness of the wall section 37 increases linearly downwards starting from the bottom edge 35.

FIGS. 4 and 8 show that the wall sections 37 are arranged in pairs diametrically opposite the security ring 25.

FIG. 4 shows that a plurality of slots 31 of equal size are arranged at the same distance from one another in a circumferential section of the security ring 25 and that the same number of slots 31 is arranged in a diametrically opposed circumferential section. As a result, the holding forces of the wall sections are distributed as uniformly as possible over the circumference of the security ring 25. In the first embodiment according to FIGS. 1 to 4, two free annular sections 49 are thus provided, which do not have any slots 31. To produce the free annular sections 49, the injection molding tool has two sliders for the production of the container closure 11. The sliders produce the slots 31 and the wall sections 37.

FIGS. 5 to 7 and in particular FIG. 8 show a second exemplary embodiment in which the slots 31 or the wall sections 37 can be distributed uniformly over the circumference of the security ring. In this exemplary embodiment, therefore, no free annular sections 49 are present. This embodiment is produced using an injection molding tool with four sliders.

The slots 31 are all of the same length and have an opening angle 51 that is 25 degrees. As a result, the bottom edges 35 are of sufficient length to reliably and undetachably hold the security ring 25 on the container neck 23.

FIG. 12 shows an exemplary embodiment with which at least one holding strip 53 is integrated into the security ring 25. The holding strip 53 has a first and a second end and a first and a second longitudinal side. The first end 55 is fixedly or undetachably connected to the free edge 29 and the second end 57 is fixedly or undetachably connected to the security ring 25. Due to the holding strip, the screw cap 13 is captively connected to the container neck 23 after the first unscrewing, and the screw cap 13 must accordingly be disposed of together with the container 24.

A recess 63 is expediently provided on the free annular section 49. The holding strip 53 is accommodated in the recess 63. The free annular section 49 provides sufficient space so that the holding strip 53 is integrated into the security ring 25 without the height of the security ring having to be increased or more material being necessary. It goes without saying that, in the case of a plurality of holding straps 53, a plurality of recesses 63 are provided for the reception thereof.

Second break-off webs 65 connect the first longitudinal side 59 of the holding strip 53 to the free edge 29 of the casing. Third break-off webs 67 connect the second longitudinal sides 59 of the holding strip 53 to the security ring 25. Like the first break-off webs 27, the intact second and third break-off webs 65, 67 indicate the original closure of the container closure. In addition, the second and third break-off webs 65, 67 are required that the container closure 11 is sufficiently stable, even when at least one holding strip 53 is provided, in order to be able to be pressed onto the container closure 11.

FIGS. 13 to 15 show the security ring 25 according to the first embodiment without the screw cap 13. In FIG. 13, the screw cap 13 is unscrewed from the container neck 23. FIGS. 15 and 16 clearly show that an annular bead 69 on which the top edges 33 rest is formed above the slots 31 on the security ring 25.

FIG. 16 shows a first and second inclination angle 71, 73. The first inclination angle 71 indicates the inclination of the first subsection 41 with respect to the plane of the bottom edge 45. The first inclination angle 71 has a magnitude between 60 and 80 degrees, or between 65 and 75 degrees. The greater the first inclination angle 71, the better the stability of the wall sections 37 with respect to vertical force effects or axial tensile forces caused by the unscrewing of the screw cap 13. However, the first inclination angle 71 must not become too large as otherwise the holding ring 39 cannot be sufficiently engaged underneath.

The second inclination angle 73 indicates the inclination of the slot 31 with respect to the plane of the bottom edge 45. The connecting line 75, which represents the inclination of the slot, is a connection of the top edge 33 to the bottom edge 35 in a plane spanned by the central axis 47 and the connecting line 75. The second inclination angle 73 is enclosed by the connecting line 75 and the plane 45. The second inclination angle 73 has a magnitude between 30 and 50 degrees, or between 35 and 45 degrees. The greater the second inclination angle 73, the more easily the container closure 11 can be demolded.

The wall sections 37 enable the security ring 25 to be reliably held on the container neck 23, even if increased axial forces act when the screw cap 13 is being unscrewed, which axial forces pull the security ring 25 upwards. Accordingly, the break-off webs 27, 65, 67 reliably tear before the security ring 25 is pulled over the holding ring 39. In addition, the configuration of the wall sections 37 makes it possible for the container closure to be demolded from its tool in a non-destructive manner and to be able to be pressed onto the container neck 23 with reduced application force (compared to the prior art). This is due to the fact that the wall sections 37 are immovable in the radial direction inwards, but have a certain mobility in the radial direction outwards.

The combination of the slots 31 or wall sections 37 having at least one holding strip 53 on the security ring 27 offers great advantages. This is due to the fact that for the at least one holding strip 53 to work properly it must tear off in a defined manner. The particularly stable fastening of the security ring 25 to the holding ring 39 enables precisely this defined tearing of the second and third break-off webs 65, 67.

FIG. 17 shows a variant of how the unscrewed screw cap 13 can be held on the container 24. The at least one holding strip 53 has a length such that the free edge 29 can be held in one of the slots 31. After unscrewing, the screw cap 13 is fixed by the dimensioning of the length of the holding strip 53, as a result of which it does not interfere with the pouring out of filling material. The slots 31 and the holding strip 53 therefore interact directly so that the screw cap 13 can be fixed. The slots 31 thus have a further benefit in addition to the reliable holding of the security ring 25. Because the screw cap 13 can be held on the security ring 25, a holding on the support ring 77, which is formed on the container neck 23, is obsolete. The length of the holding strip 53 does not have to be adapted to different diameters and positions of the support ring 77, but can instead always have the same length.

FIG. 18 shows a further embodiment with which the free edge 29 is pulled from a first and second holding strip 53*a*, 53*b* into the slot. In this case, the holding strips 53*a*, may be tensioned so that the screw cap 13 is fixedly held on the slot 31. Preferably, the free edge 29 is pulled onto the slot 31 such that the casing 15 rests against the top edge 33 of the slot 31 and the free edge 29 rests against the first subsection 41 of the wall section 37. Due to the fact that the screw cap 13 rests on an edge and a face, the molding for the particularly fixed holding of the security ring 25 on the container neck 23 is also ideally used for holding the screw cap 13 in a fixed and wiggle-free manner on the security ring 25.

The invention claimed is:

1. A container closure made of plastic for closing a container, comprising:

a screw cap comprising a cylindrical casing having an internal thread and a lid disc adjoining the cylindrical casing;

a security ring connected by a plurality of first break-off webs to a free edge of the cylindrical casing and having a plurality of slots-distributed over a circumference of the security ring, each slot having a top edge and a bottom edge, wherein the top edge is formed by a section of the security ring that extends in a shape of a circular arc and the bottom edge is formed by a wall section that is inclined inwards in a radial direction; and the bottom edge of each slot forming a form-fitting engagement into an abutment in the form of a holding ring arranged in a region of a container neck;

wherein the wall section has a lesser wall thickness than remaining portions of the security ring, wherein a region of the bottom edge has a smallest wall thickness.

2. The container closure according to claim 1, wherein the wall section comprises a first subsection, that corresponds to an obliquely positioned casing section, and comprises two second subsections that connect the first subsection to the cylindrical casing.

3. The container closure according to claim 2, wherein the two second subsections are oriented obliquely inwards facing each other.

4. The container closure according to claim 2, wherein the bottom edge corresponds to free edges of the first subsection and the two second subsections and lies in one plane.

5. The container closure according to claim 4, wherein the plane in which the bottom edge lies is oriented perpendicular to a central axis of the container closure.

6. The container closure according to claim 1, wherein a wall thickness of each wall section decreases in an axial direction starting from a free end of the security ring.

7. The container closure according to claim 1, wherein at least two diametrically opposed slots are present.

8. The container closure according to claim 1, wherein each of the plurality of slots is of equal size and arranged at a same distance from one another in a circumferential section of the security ring and that a same number of the plurality of slots is arranged in a diametrically opposed circumferential section.

9. The container closure according to claim 1, wherein the plurality of slots is distributed uniformly over the circumference of the security ring.

10. The container closure according to claim 1, wherein each of the plurality of slots is the same length and have an opening angle of 15 to 30 degrees on the circumference of the security ring.

11. The container closure according to claim 1, wherein the container closure has at least one holding strip having a first and a second end and a first and a second longitudinal side, wherein the first end is undetachably connected to a free edge of the cylindrical casing and the second end is undetachably connected to the security ring.

12. The container closure according to claim 11, wherein the at least one holding strip is of a length such that, in the unscrewed state of the screw cap, the free edge of the cylindrical casing can be locked in one slot of the plurality of slots and is held in the one slot by the at least one holding strip.

13. The container closure according to claim 12, wherein two holding straps are provided, the length of which is dimensioned such that the two holding straps pull the free edge into the one slot when the screw cap is unscrewed, whereby the free edge locks in the one slot.

14. The container closure according to claim 12, wherein the cylindrical casing rests on the top edge of the one slot 31 and the free edge rests on the first subsection of the wall section.

15. The container closure claim 11, further comprising at least one recess on the security ring for receiving the holding strip.

16. The container closure according to claim 15, wherein the at least one recess is provided in a circumferential or annular section of the security ring, which is free of slots.

17. The container closure according to claim 11, further comprising a plurality of second break-off webs connecting a first longitudinal side of the holding strip to the free edge of the casing and a plurality of third break-off webs connecting a second longitudinal side of the holding strip to the security ring.

18. A container-, comprising:

a plastic bottle comprising a container closure;

a screw cap comprising a cylindrical casing having an internal thread and a lid disc adjoining the cylindrical casing;

a security ring connected by a plurality of first break-off webs to a free edge of the cylindrical casing and having a plurality of slots distributed over a circumference of the security ring, each slot having a top edge and a bottom edge, wherein the top edge is formed by a section of the security ring that extends in a shape of a circular arc and the bottom edge is formed by a wall section that is inclined inwards in a radial direction;

a container neck having an external thread;

a holding ring below the external thread protruding outwards in the radial direction, the bottom edge of each slot forming a form-fitting engagement into an abutment in the form of a holding ring arranged in a region of a container neck;

wherein the wall section has a lesser wall thickness than remaining portions of the security ring, wherein a region of the bottom edge has a smallest wall thickness.

19. A container closure made of plastic for closing a container, comprising:

a screw cap comprising a cylindrical casing having an internal thread and a lid disc adjoining the cylindrical casing;

a security ring connected by a plurality of first break-off webs to a free edge of the cylindrical casing and having a plurality of slots distributed over a circumference of the security ring, each slot having a top edge and a bottom edge, wherein the top edge is formed by a section of the security ring that extends in a shape of a circular arc and the bottom edge is formed by a wall section that is inclined inwards in a radial direction; and the bottom edge of each slot forming a form-fitting engagement into an abutment in the form of a holding ring arranged in a region of a container neck;

wherein a wall thickness of the wall section decreases in an axial direction starting from a free end of the security ring.

20. A container closure made of plastic for closing a container, comprising:

a screw cap comprising a cylindrical casing having an internal thread and a lid disc adjoining the cylindrical casing;

a security ring connected by a plurality of first break-off webs to a free edge of the cylindrical casing and having a plurality of slots distributed over a circumference of the security ring, each slot having a top edge and a bottom edge, wherein the top edge is formed by a section of the security ring that extends in a shape of a circular arc and the bottom edge is formed by a wall section that is inclined inwards in a radial direction; and the bottom edge of each slot forming a form-fitting engagement into an abutment in the form of a holding ring arranged in a region of a container neck;

wherein the container closure has at least one holding strip having a first and a second end and a first and a second longitudinal side, wherein the first end is undetachably connected to a free edge of the cylindrical casing and the second end is undetachably connected to the security ring; and wherein the at least one holding strip is of a length such that, in the unscrewed state of the screw cap, the free edge of the cylindrical casing can be locked in one slot of the plurality of slots and is held in the one slot by the at least one holding strip.

21. A container closure made of plastic for closing a container, comprising:

a screw cap comprising a cylindrical casing having an internal thread and a lid disc adjoining the cylindrical casing;

a security ring connected by a plurality of first break-off webs to a free edge of the cylindrical casing and having a plurality of slots distributed over a circumference of the security ring, each slot having a top edge and a bottom edge, wherein the top edge is formed by a section of the security ring that extends in a shape of a circular arc and the bottom edge is formed by a wall section that is inclined inwards in a radial direction; and the bottom edge of each slot forming a form-fitting engagement into an abutment in the form of a holding ring arranged in a region of a container neck;

the container closure having at least one holding strip having a first and a second end and a first and a second longitudinal side, wherein the first end is undetachably connected to a free edge of the cylindrical casing and the second end is undetachably connected to the security ring; and the security ring defining at least one recess for receiving the at least one holding strip.

* * * * *